US007834810B2

(12) United States Patent
Reece et al.

(10) Patent No.: US 7,834,810 B2
(45) Date of Patent: Nov. 16, 2010

(54) ANTENNAE ATTACHABLE TO AN ELECTRONIC DEVICE ENCLOSURE OR OTHER STRUCTURE

(75) Inventors: John K. Reece, Colorado Springs, CO (US); Clinton R. Ransdell, Colorado Springs, CO (US)

(73) Assignee: Intel Corporation, Santa Clara, CA (US)

( * ) Notice: Subject to any disclaimer, the term of this patent is extended or adjusted under 35 U.S.C. 154(b) by 1045 days.

(21) Appl. No.: 10/881,603

(22) Filed: Jun. 29, 2004

(65) Prior Publication Data

US 2005/0285800 A1 Dec. 29, 2005

(51) Int. Cl.
*H01Q 1/24* (2006.01)

(52) U.S. Cl. ..... 343/702; 343/872; 343/892

(58) Field of Classification Search ..... 343/702, 343/872, 878, 880, 892, 905, 906; 455/575.7
See application file for complete search history.

(56) References Cited

U.S. PATENT DOCUMENTS 5,083,136 A * 1/1992 Wells ..... 343/822
5,606,732 A * 2/1997 Vignone, Sr. ..... 455/269
5,621,420 A * 4/1997 Benson ..... 343/791
5,673,053 A * 9/1997 Marthinsson ..... 343/728
5,764,194 A * 6/1998 Brown ..... 343/726
5,913,174 A * 6/1999 Casarez et al. ..... 455/557
6,151,480 A * 11/2000 Fischer et al. ..... 340/310.12
6,167,312 A * 12/2000 Goedeke ..... 607/60
6,259,418 B1 * 7/2001 Jones et al. ..... 343/846
6,268,836 B1 * 7/2001 Faulkner et al. ..... 343/895
6,373,438 B1 * 4/2002 Hwang ..... 343/702
7,039,399 B2 * 5/2006 Fischer ..... 455/422.1
2002/0003571 A1 * 1/2002 Schofield et al. ..... 348/148

OTHER PUBLICATIONS

Sierra Wireless PC3300, Information Product Sheet, Wireless Wide-Area PC Card for the Enhanced Sprint Nationwide PCS Network, 2004, pp. 1-2, Sierra Wireless.
AirCard 350, User Guide, # 2110213 Rev 3.0, Apr. 2000, pp. 1-81, Sierra Wireless.
AirCard 555 Wireless Network Card, Installation Guide, # 2130163 Rev 3.0, May 2003, pp. 1-68, Sierra Wireless.
AirCard 750 Wireless Network Card, Installation Guide, # 2130204 Rev 1.3, Jul. 2003, pp. 1-68, Sierra Wireless.

* cited by examiner

*Primary Examiner*—Michael C Wimer
(74) *Attorney, Agent, or Firm*—Blakely, Sokoloff, Taylor & Zafman LLP

(57) ABSTRACT

Attachable/detachable antennae for use with electronic systems.

32 Claims, 3 Drawing Sheets

ANTENNAE ATTACHABLE TO AN ELECTRONIC DEVICE ENCLOSURE OR OTHER STRUCTURE

TECHNICAL FIELD

Embodiments of the invention relate to antennae for use in wireless communications. More particularly, embodiments of the invention relate to antennae having elements that are attachable to host device enclosures.

BACKGROUND

Typical wireless data modems for use with laptop computers are designed with "stubby" flip up, full quarter wave or half wave antennae. The efficiency (gain) and radiation pattern performance of these antennae are often compromised for the sake of cost and/or aesthetic appeal. Furthermore, radio frequency (RF) interference generated by a processor and/or data transfer mechanisms within the host system may significantly reduce the sensitivity level of PC card based radio receivers.

While built-in antennae may be adequate in areas of high base station deployment density characterized by high carrier power levels, these built-in antennae may be inadequate in areas where the base station density and carrier power levels are relatively low. Thus, "stubby" and built-in antennae suffer from operational deficiencies.

BRIEF DESCRIPTION OF THE DRAWINGS

Embodiments of the invention are illustrated by way of example, and not by way of limitation, in the figures of the accompanying drawings in which like reference numerals refer to similar elements.

DETAILED DESCRIPTION

In the following description, numerous specific details are set forth. However, embodiments of the invention may be practiced without these specific details. In other instances, well-known circuits, structures and techniques have not been shown in detail in order not to obscure the understanding of this description.

The "clip-on" antennae described herein may include an antenna element tuned to provide coverage for one or more communication protocol frequency ranges (e.g., GSM, DCS, PCS, LAN, WAN, WiFi). In one embodiment, a clip-on antenna may include a clamping mechanism to attach the antenna element to, for example, an edge of a laptop computer screen, an edge of a flat panel display, a frame of a desk lamp, or other structure. In one embodiment, the clip-on antenna may include a spring clip mechanism attached to a molded plastic support frame/radome to provide a clamping force sufficient to hold the antenna in place.

To allow the antenna to be adaptable for use with systems having communications interfaces, for example, card slots on either side of an enclosure, the clip mechanism may be designed so that the clip-on assembly is reversible. By providing the assembly in this way, the relation of the antenna element to the system and an RF cable egress direction may remain constant regardless of the side to which the antenna is attached resulting in performance consistency. The RF cable may be, for example, a coaxial cable, a twisted pair cable or an optical fiber. While the antennae described herein are referred to at clip-on antennae, any type of attachment mechanism that may allow antennae to be attached and removed from a structure may be used.

Figure 1:
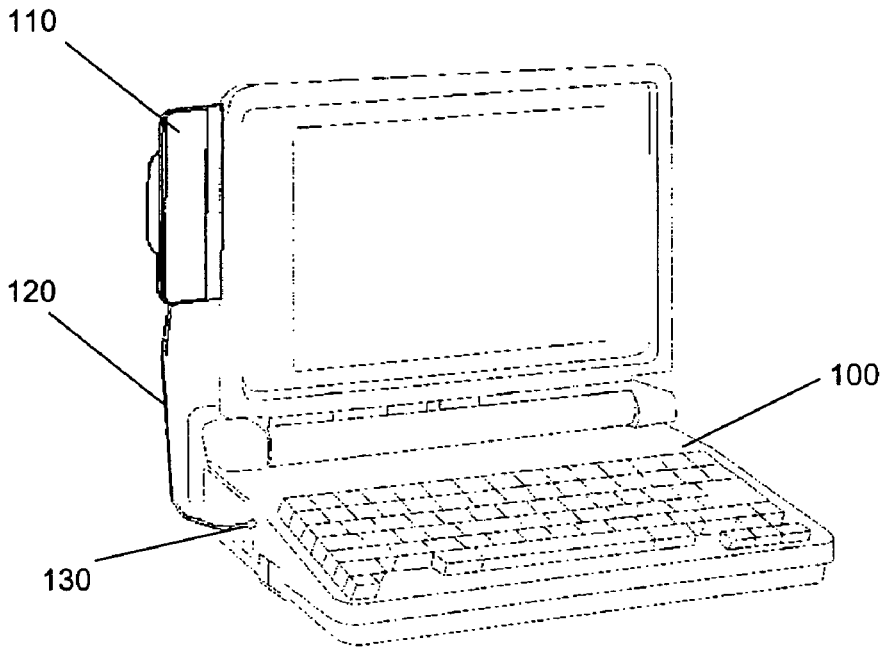
FIG. 1 illustrates one embodiment of a clip-on antenna element connected to a laptop computer system enclosure.

FIG. 1 illustrates one embodiment of a clip-on antenna element connected to a laptop computer system enclosure. While the clip-on antenna element is illustrated in use with a laptop computer system, the clip-on antenna element described herein may be used with any electronic system (e.g., desktop computer system, set top box, personal digital assistant, palmtop computer system) having a wireless communication interface.

Laptop computer system 100 may be any type of laptop computer system. In one embodiment, clip-on antenna 110 operates by attaching to an upright portion of laptop computer system 100 enclosure, for example, the display portion. When used with other types of electronic systems, clip-on antenna 110 may be attached to other devices or structures. For example, when used with a desktop computer system, clip-on antenna 110 may be attached to a flat panel display device or to a CRT display device or even to an item on a desk such as a lamp. Because of the clipping ability of clip-on antenna 110 a user of an electronic system may position clip-on antenna 110 in various places depending on conditions to achieve improved antenna performance. In an alternate embodiment, clip-on antenna 110 may be designed to be attached to a top or horizontal portion of a display device, which may or may not include an adjustable antenna element (not shown in FIG. 1).

In one embodiment, antenna 110 may be coupled with functional components of computer system via cable 120. Any type of cable known in the art appropriate for carrying signals to be transmitted by antenna 110 or received by antenna 110 may be used. Cable 120 may include connector 130 that may provide an electrical interface between cable 120 and a functional component of computer system 100. Connector 130 may be any type of electrical connector that may maintain a connection and transfer a signal between cable 120 and a component of computer system 100.

When a wireless connection is no longer needed, antenna 110 may be removed from computer system 100 and stored. Removing antenna 110 may allow a computer user to store antenna 110 in a more secure location than an antenna that is attached to the computer system or an antenna that is, for example, part of a PCMCIA card or other removable component that extends beyond an enclosure of the computer system.

Figure 2:
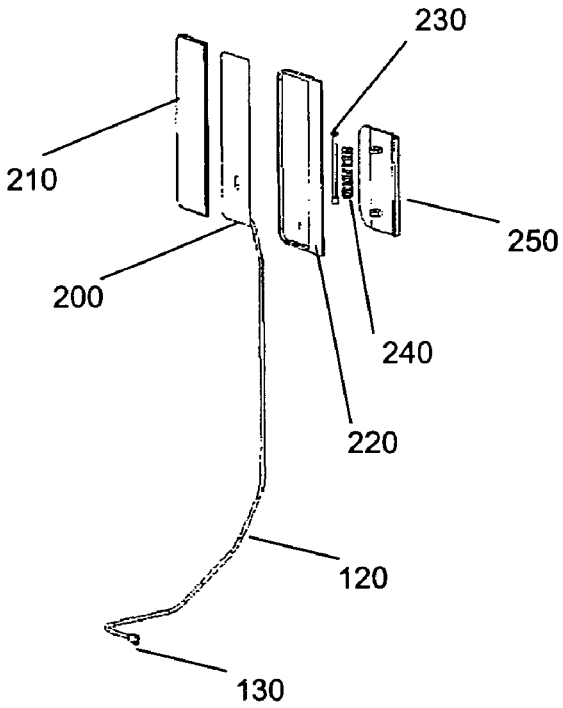
FIG. 2 is an exploded view of one embodiment of a clip-on antenna.

FIG. 2 is an exploded view of one embodiment of a clip-on antenna. In one embodiment, the clip-on antenna may include opposing support frames that house an antenna element with a spring-loaded clip to attach the antenna to an enclosure or structure.

In one embodiment, antenna element 200 may be housed by support frames 210 and 220. In one embodiment, support frames 210 and 220 may completely enclose antenna element 200. In an alternate embodiment, support frames 210 and 220 may only partially enclose antenna element 200. In one embodiment support frames 210 and 220 may be plastic and may operate as a radome when connected to house antenna element 200. Other types of materials may be used. In one embodiment antenna element 200 may cover the 824 MHz to 960 MHz cellular/GSM bands and/or the 1710 MHz to 1990 MHz DCS/PCS bands. Other and/or different frequency bands may also be supported.

In one embodiment, support frame 220 may be connected to clamping element 250 by spring 240 and pin 230. In one embodiment, spring 240 may be configured to cause clamping element 250 to apply pressure toward support frame 220. The pressure applied by clamping element 250 may allow the antenna assembly to remain attached to a laptop computer enclosure or other device, for example, as illustrated in FIG. 1.

In one embodiment, when positioned in an approximately upright position, antenna element 200 may be positioned away from interference caused by operation of components of a host electronic system and may provide improved radiation coverage in the azimuth plane around the host electronic system. In one embodiment, antenna element 200 may be coupled with a removable card, expansion card, integrated interface, or other interface via cable 120 and connector 130.

Figure 3:
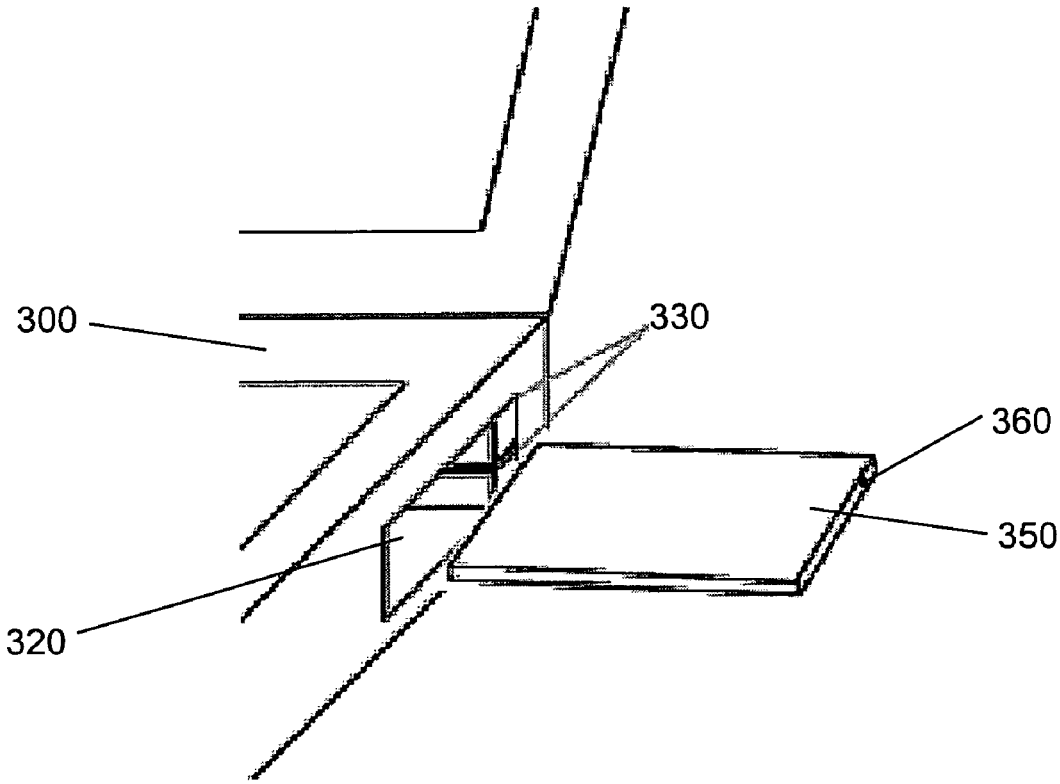
FIG. 3 illustrates one embodiment of a removable card and computer system and enclosure configured to operate with the removable card.

FIG. 3 illustrates one embodiment of a removable card and computer system and enclosure configured to operate with the removable card. Computer system enclosure 300 may house a computer system or other electronic device configured to operate using card 350. The computer system may be, for example, a laptop computer system. Card 350 may be, for example, any type of PC card.

In one embodiment, card 350 is a Type II PC card as defined by the PCMCIA specifications cited below. PC cards are approximately credit card sized memory or I/O devices that fit into slots in electronic systems that conform to the PCMCIA standards. PC cards are based on standards published by the Personal Computer Memory Card International Association. For example, PCMCIA Standard 2.1 was published in 1993 and defines a 68-pin connector and cards of three sizes or types. In alternate embodiments, other cards that do not conform to the PCMCIA standards may be used.

In one embodiment, card 350 may be inserted into enclosure 300 through slot(s) 320. Using the PCMCIA standards as an example, the dimensions of slot(s) 320 depend on whether slot(s) 320 support Type I, Type II and/or Type III PC cards. When inserted into slot(s) 320, card 350 may connect with an electrical interface within slot(s) 320. Again using the PCMCIA standards as an example, slot(s) 320 may include one or more sets of 68-pin electrical interfaces.

When mated with the electrical interface, card 350 may provide functionality to the electronic system that may not have been available in the absence of card 350. In one embodiment, card 350 may be ejected from slot(s) 320 by a user pressing one of button(s) 330 corresponding to the slot in which card 350 is inserted. PC card interfaces, slots and ejection mechanisms are known in the art.

In one embodiment, card 350 may include interface 360 configured to mate with a connector (e.g., 130 in FIGS. 1 and 2) of a cable (e.g., 120 in FIGS. 1 and 2) that may provide signals to and from an antenna element. In an alternate embodiment, the host computer system may include interface 360 rather than interface 360 being part of card 350. Any interface that allows signals to be received from and/or transmitted to an antenna as described herein may be used.

Figure 4:
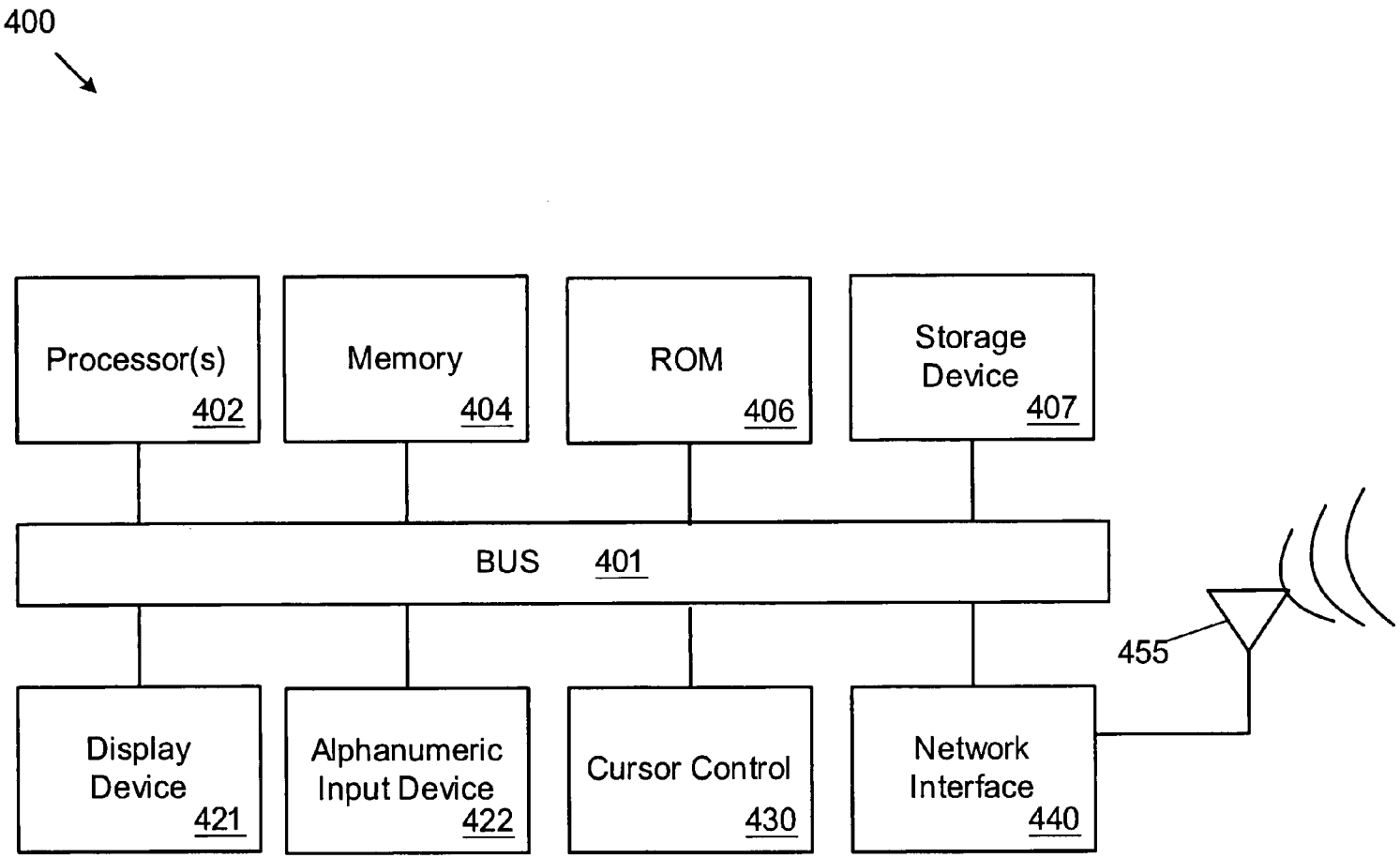
FIG. 4 is a block diagram of one embodiment of an electronic system.

FIG. 4 is a block diagram of one embodiment of an electronic system. The electronic system illustrated in FIG. 4 is intended to represent a range of electronic systems including, for example, desktop computer systems, laptop computer systems, cellular telephones, personal digital assistants (PDAs) including cellular-enabled PDAs, set top boxes. Alternative computer systems can include more, fewer and/or different components.

Electronic system 400 includes bus 401 or other communication device to communicate information, and processor 402 coupled to bus 401 that may process information. While electronic system 400 is illustrated with a single processor, electronic system 400 may include multiple processors and/or co-processors. Electronic system 400 further may include random access memory (RAM) or other dynamic storage device 404 (referred to as main memory), coupled to bus 401 and may store information and instructions that may be executed by processor 402. Main memory 404 may also be used to store temporary variables or other intermediate information during execution of instructions by processor 402.

Electronic system 400 may also include read only memory (ROM) and/or other static storage device 406 coupled to bus 401 that may store static information and instructions for processor 402. Data storage device 407 may be coupled to bus 401 to store information and instructions. Data storage device 407 such as a magnetic disk or optical disc and corresponding drive may be coupled to electronic system 400.

Electronic system 400 may also be coupled via bus 401 to display device 421, such as a cathode ray tube (CRT) or liquid crystal display (LCD), to display information to a user. Alphanumeric input device 422, including alphanumeric and other keys, may be coupled to bus 401 to communicate information and command selections to processor 402. Another type of user input device is cursor control 430, such as a mouse, a trackball, or cursor direction keys to communicate direction information and command selections to processor 402 and to control cursor movement on display 421.

Electronic system 400 further may include network interface 440 to provide access to a network, such as a local area network. Network interface(s) 440 may include, for example, a wireless network interface having antenna 455, which may represent one or more antenna(e). Antenna 455 may include a clip-on antenna element as described herein.

In one embodiment, network interface(s) 440 may provide access to a local area network, for example, by conforming to IEEE 802.11b and/or IEEE 802.11g standards, and/or the wireless network interface may provide access to a personal area network, for example, by conforming to Bluetooth standards. Other wireless network interfaces and/or protocols can also be supported. IEEE 802.11b corresponds to IEEE Std. 802.11b-1999 entitled "Local and Metropolitan Area Networks, Part 11: Wireless LAN Medium Access Control (MAC) and Physical Layer (PHY) Specifications: Higher-Speed Physical Layer Extension in the 2.4 GHz Band," approved Sep. 16, 1999 as well as related documents.

IEEE 802.11g corresponds to IEEE Std. 802.11g-2003 entitled "Local and Metropolitan Area Networks, Part 11: Wireless LAN Medium Access Control (MAC) and Physical Layer (PHY) Specifications, Amendment 4: Further Higher Rate Extension in the 2.4 GHz Band," approved Jun. 27, 2003 as well as related documents. Bluetooth protocols are described in "Specification of the Bluetooth System: Core, Version 1.1," published Feb. 22, 2001 by the Bluetooth Special Interest Group, Inc. Associated as well as previous or subsequent versions of the Bluetooth standard may also be supported.

In addition to, or instead of, communication via wireless LAN standards, network interface(s) 440 may provide wireless communications using, for example, Time Division, Multiple Access (TDMA) protocols, Global System for Mobile Communications (GSM) protocols, Code Division, Multiple Access (CDMA) protocols, and/or any other type of wireless communications protocol.

Reference in the specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment.

While the invention has been described in terms of several embodiments, those skilled in the art will recognize that the invention is not limited to the embodiments described, but can be practiced with modification and alteration within the spirit and scope of the appended claims. The description is thus to be regarded as illustrative instead of limiting.

What is claimed is:

1. An apparatus comprising:

an antenna element;

an antenna enclosure that encloses the antenna element, the antenna enclosure having a clamping mechanism to attach the antenna enclosure to an external structure, wherein the clamping mechanism includes a clamping element connected to the antenna enclosure with a pin and a spring such that the clamping element to apply pressure toward the antenna enclosure;

a cable coupled with the antenna element and extending beyond the antenna enclosure; and a connector at an end of the cable opposite the antenna element to connect with an interface of an electronic system wherein the interface comprises a removable card wherein the removable card comprises a Type II PCMCIA card.

2. The apparatus of claim 1 wherein the cable comprises a radio frequency cable.

3. The apparatus of claim 2 wherein the radio frequency cable comprises a coaxial cable.

4. The apparatus of claim 2 wherein the radio frequency cable comprises a twisted pair cable.

5. The apparatus of claim 2 wherein the radio frequency cable comprises an optical fiber.

6. The apparatus of claim 1 wherein the antenna element communicates cellular telephone signals.

7. The apparatus of claim 6 wherein the cellular telephone signals are transmitted in a range of 824 MHz to 960 MHz.

8. The apparatus of claim 6 wherein the cellular telephone signals are transmitted in a range of 1710 MHz to 1990 MHz.

9. The apparatus of claim 1 wherein the antenna element communicates local area network signals.

10. The apparatus of claim 9 wherein the local area network signals conform to IEEE Std. 802.11b and/or IEEE Std. 802.11g.

11. The apparatus of claim 1 wherein the antenna element communicates personal area network signals.

12. The apparatus of claim 11 wherein the personal area network protocol comprises a Bluetooth protocol.

13. The apparatus of claim 1 wherein the antenna enclosure completely encloses the antenna element.

14. The apparatus of claim 1 wherein the clamping mechanism comprises:

a clamping element; and a spring configured to cause the clamping element to be forced toward the antenna enclosure to cause a clamping force against the antenna enclosure.

15. The apparatus of claim 1 wherein the external structure comprises a display of a laptop computer.

16. The apparatus of claim 1 wherein the antenna element is configured to attach to the external structure in a substantially vertical position.

17. The apparatus of claim 1 wherein the antenna element is configured to attach to the external structure in a substantially horizontal position.

18. A system comprising:

a bus;

a digital signal processor coupled with the bus;

an antenna element coupled with the bus; and an antenna enclosure that encloses the antenna element, the antenna enclosure having a clamping mechanism to attach the antenna enclosure to an external structure, wherein the clamping mechanism includes a clamping element connected to the antenna enclosure with a pin and a spring such that the clamping element to apply pressure toward the antenna enclosure;

a cable coupled with the antenna element and extending beyond the antenna enclosure; and a connector at an end of the cable opposite the antenna element to connect with an interface of an electronic system wherein the interface comprises a removable card wherein the removable card comprises a Type II PCMCIA card.

19. The system of claim 18 further comprising a cable coupled with the antenna element and extending beyond the antenna enclosure.

20. The system of claim 19 wherein the cable comprises a radio frequency cable.

21. The system of claim 20 wherein the radio frequency cable comprises a coaxial cable.

22. The system of claim 20 wherein the radio frequency cable comprises a twisted pair cable.

23. The system of claim 20 wherein the radio frequency cable comprises an optical fiber.

24. The system of claim 18 wherein the antenna element communicates cellular telephone signals.

25. The system of claim 24 wherein the cellular telephone signals are transmitted in a range of 824 MHz to 960 MHz.

26. The system of claim 24 wherein the cellular telephone signals are transmitted in a range of 1710 MHz to 1990 MHz.

27. The system of claim 18 wherein the antenna element communicates local area network signals.

28. The system of claim 27 wherein the local area network signals conform to IEEE Std. 802.11b and/or IEEE Std. 802.11g.

29. The system of claim 18 wherein the antenna element communicates personal area network signals.

30. The system of claim 29 wherein the personal area network protocol comprises a Bluetooth protocol.

31. The system of claim 18 wherein the antenna element is configured to attach to the external structure in a substantially vertical position.

32. The system of claim 18 wherein the antenna element is configured to attach to the external structure in a substantially horizontal position.

* * * * *